US009312632B2

(12) United States Patent
Colantuono et al.

(10) Patent No.: US 9,312,632 B2
(45) Date of Patent: Apr. 12, 2016

(54) HEAT RESISTANT MAGNETIC ELECTRICAL CONNECTOR

(71) Applicant: Genesis Technology USA, Inc, Norcross, GA (US)

(72) Inventors: Robert Colantuono, Dover, PA (US); Earl Anthony Daughtry, Jr., Lawrenceville, GA (US)

(73) Assignee: Genesis Technology USA, Inc., Norcross, GA (US)

( * ) Notice: Subject to any disclaimer, the term of this patent is extended or adjusted under 35 U.S.C. 154(b) by 0 days.

(21) Appl. No.: 14/483,265

(22) Filed: Sep. 11, 2014

(65) Prior Publication Data

US 2015/0093920 A1 Apr. 2, 2015

Related U.S. Application Data

(60) Provisional application No. 61/883,690, filed on Sep. 27, 2013.

(51) Int. Cl.

| | |
|---|---|
| ***H01R 11/30*** | (2006.01) |
| ***H01R 13/62*** | (2006.01) |
| *H01R 13/533* | (2006.01) |
| *H01R 12/75* | (2011.01) |

(52) U.S. Cl.

CPC ..... *H01R 13/6205* (2013.01); *H01R 12/75* (2013.01); *H01R 13/533* (2013.01); *Y10T 29/49133* (2015.01); *Y10T 29/49142* (2015.01)

(58) Field of Classification Search

CPC ..... H01R 13/6205

USPC ..... 439/39

See application file for complete search history.

(56) References Cited

U.S. PATENT DOCUMENTS

| | | | | |
|---|---|---|---|---|
| 5,587,568 | A * | 12/1996 | Lothamer | H01H 1/403 200/16 D |
| 7,351,066 | B2 * | 4/2008 | DiFonzo | H01R 13/641 439/39 |
| 2007/0259536 | A1 * | 11/2007 | Long | H01R 13/6205 439/39 |
| 2013/0040470 | A1 * | 2/2013 | Gao | H01R 13/508 439/39 |
| 2013/0050958 | A1 * | 2/2013 | Bdeir | H01R 13/6205 361/730 |

* cited by examiner

*Primary Examiner* — Tho D Ta

(74) *Attorney, Agent, or Firm* — Lee & Hayes, PLLC; Charles L. Warner

(57) ABSTRACT

A magnetic connector system (100) having a cable-end connector (110) and a printed circuit board connector (115). The cable-end connector has a ferro-magnetic strike plate (155). The printed circuit board connector has plugs or bosses (120A, 120B) which mate with corresponding sockets in the cable-end connector and are configured to properly align or orient the connectors. The plugs may include electrical contacts (120A1, 120A2, 120B1) which mate with corresponding electrical contacts in the cable-end connector. The printed circuit board connector has a magnet assembly (122) which is inserted or installed into a receiving area, and secured by retainers, after the printed circuit board connector has been wave- or reflow-soldered to a printed circuit board. The magnet assembly and the strike plate hold the cable-end connector and the printed circuit board connector together.

9 Claims, 9 Drawing Sheets

HEAT RESISTANT MAGNETIC ELECTRICAL CONNECTOR

CROSS-REFERENCE TO RELATED APPLICATION

This application claims the priority of U.S. Provisional Patent Application No. 61/883,690, filed Sep. 27, 2013, and titled "Heat Resistant Magnetic Connector", the entire disclosure and contents of which are hereby incorporated by reference herein.

BACKGROUND

Most laptops use a barrel style connector system to convey operating power from a power supply to the laptop. The cable-end plug is inserted into a socket on the laptop, and is held there by friction. Connectors have also been made which use magnetism to hold a cable connector to a corresponding connector on the laptop. This is gaining popularity for use with notebook-type computers and "tablets".

When a magnet is heated past a certain temperature, the Curie temperature, it begins to lose its magnetism, and this loss of magnetism is irreversible. That is, merely cooling the magnet below the Curie temperature does not restore the magnetism. Printed circuit boards often include surface mount technology (SMT) components and other components. These components are soldered to the board by, for example, wave-soldering or reflow-soldering operations. During these operations the components may be subjected to high soldering temperatures and/or longer durations of higher temperatures. This can result in loss of magnetism of the magnets in the connectors.

To avoid this loss of magnetism, the magnetic connectors are frequently hand-soldered to the PC board after other soldering operations have been completed. Hand-soldering operations, however, are time-consuming and labor intensive and, therefore, are expensive. Also, because they are performed by humans rather than machines, the quality of hand-soldering operations is subject to variations which can lead to poor or weak solder connections, poor or failed electrical connections, and even damage to the PC board, such as but not limited to a conductor trace on a PC board separating from the PC board due to excessive heating.

It is with respect to these considerations and others that the disclosure made herein is presented.

SUMMARY

A heat resistant magnetic electrical connector is described. The heat resistant magnetic connector includes a body formed from an electrically insulating material, the entire body being tolerant of soldering temperatures associated with wave- or reflow-soldering the heat resistant magnetic electrical connector to a printed circuit board, first and second electrical conductors extending through the body, and a magnet assembly for insertion into a receiving area on a back side of the body after the first and second electrical conductors have been wave- or reflow-soldered to a printed circuit board. The body may include first and second plugs which extend from a face of the body, the first plug being located toward a first end of the face and having a first width, the second plug being located toward a second, opposite end of the face and having a second, different width. The body may also include retainers for securing the magnet assembly in the body after the first and second electrical conductors have been wave- or reflow-soldered to a printed circuit board. The body may also include first and second openings positioned between the first and second plugs and extending from the face through the body to the receiving area. The magnet assembly may have a first end and a second end, the first end having first and second extensions, the first and second extensions extending into the first and second openings. The first and second electrical conductors may extend through the body and form exposed first and second electrical contacts, respectively, forward of the face, and form first and second connector pins, respectively, at respective first and second predetermined locations other than the face or forward of the face, such as on the back or the bottom of the body. The first and second connector pins are configured for being wave- or reflow-soldered to conductors on the printed circuit board.

Another magnetic electrical connector is also described. The magnetic electrical connector has a body formed from an electrically insulating material, the entire body being tolerant of wave- or reflow-soldering temperatures, first and second electrical conductors extending through the body, and a strike plate of a material which is attracted to, or which attracts, a magnet. The body may include a face, first and second sockets recessed in the face, and a recessed area in the face between the first and second sockets. The first socket may be located toward a first end of the face and have a first width, and the second socket may be located toward a second, opposite end of the face and have a second, different width. The first and second electrical conductors may form exposed first and second electrical contacts, respectively, at the face and form first and second connector pins, respectively, at respective first and second predetermined locations not on the face, such as on the back of the body. The first and second connector pins are configured for being wave- or reflow-soldered to electrical wires in a connecting cable. The strike plate may be positioned in the recessed area.

A method for manufacturing a heat resistant magnetic electrical connector is also described. The method includes providing a body formed from an electrically insulating material which is tolerant of soldering temperatures associated with wave- or reflow-soldering the heat resistant magnetic electrical connector to a printed circuit board, inserting first and second electrical conductors into the body, and providing a magnet assembly for insertion into a receiving area in the back side of the body after the first and second electrical conductors have been wave- or reflow-soldered to a printed circuit board. The body may include first and second plugs which extend from a face of the body and first and second openings. The first plug may be located toward a first end of the face and have a first width, the second plug may be located toward a second, opposite end of the face and have a second, different width. The first and second openings may be positioned between the first and second plugs and extend from the face through the body to the receiving area. The magnet assembly may have a first end and a second end, the first end having first and second extensions, and the first and second extensions may extend into the first and second openings. The body may also include retainers for holding the magnet assembly at least partially within the receiving area. The first and second electrical conductors extend through the body and form exposed first and second electrical contacts, respectively, forward of the face and form first and second connector pins, respectively, at respective first and second predetermined locations not on the face or forward of the face, such as on the back or the bottom of the connector. The first and second connector pins are configured for being wave- or reflow-soldered to conductors on the printed circuit board.

A method of installing a heat resistant magnetic electrical connector on a printed circuit board is also described. The method includes positioning an electrical connector on a printed circuit board, wave- or reflow-soldering the electrical connector to the printed circuit board, and then installing a magnet into a receiving area on a back side of the electrical connector. The magnet may be installed by installing a magnet assembly which comprises a magnet and magnetic flux plates such that an end of each magnetic flux plate extends from a face of the electrical connector.

DETAILED DESCRIPTION

Figure 1:
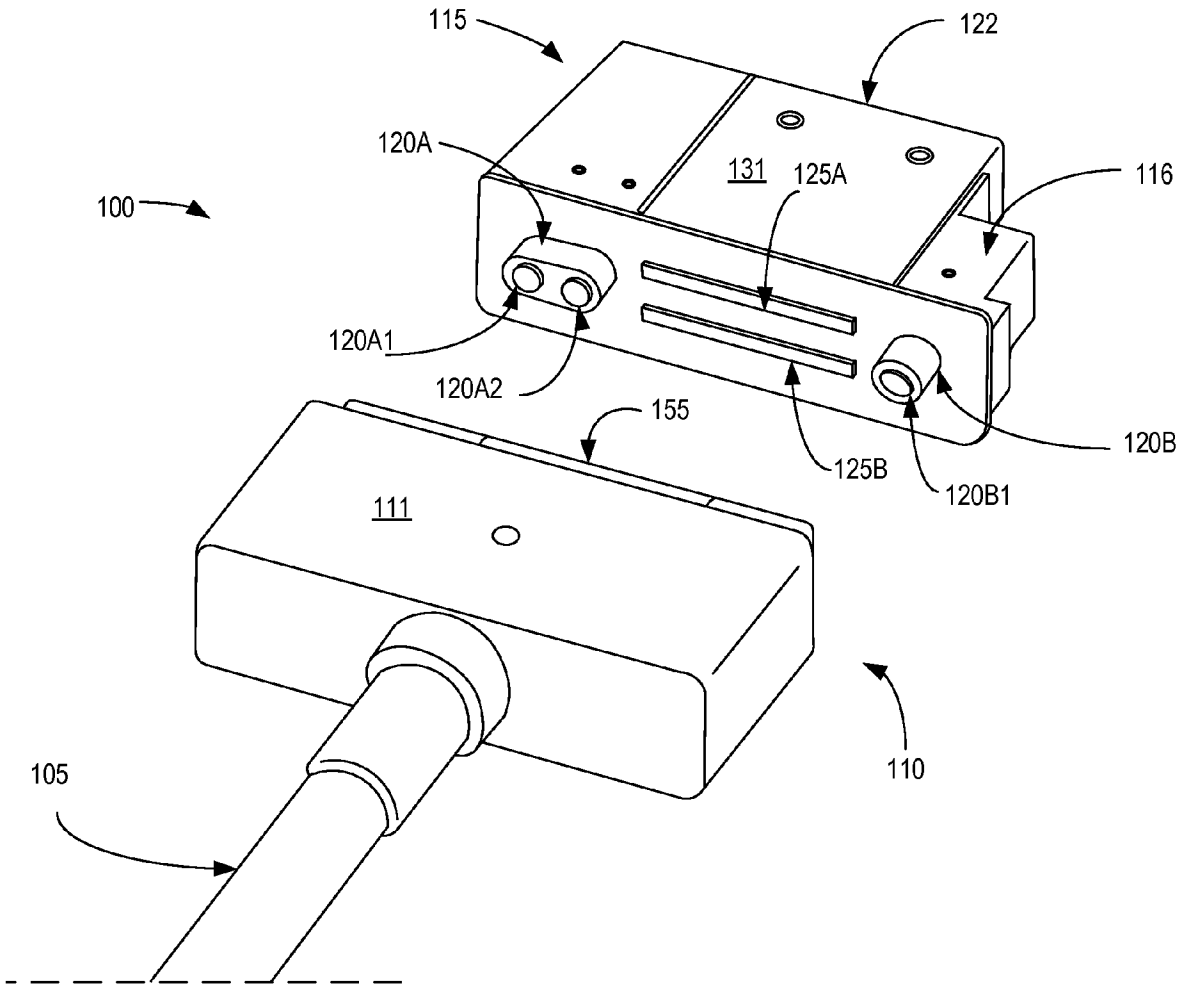
FIG. 1 illustrates a connector system which includes a cable-end connector and a board connector suitable and intended for wave- or reflow-soldering onto a printed circuit board.
Figure 8:
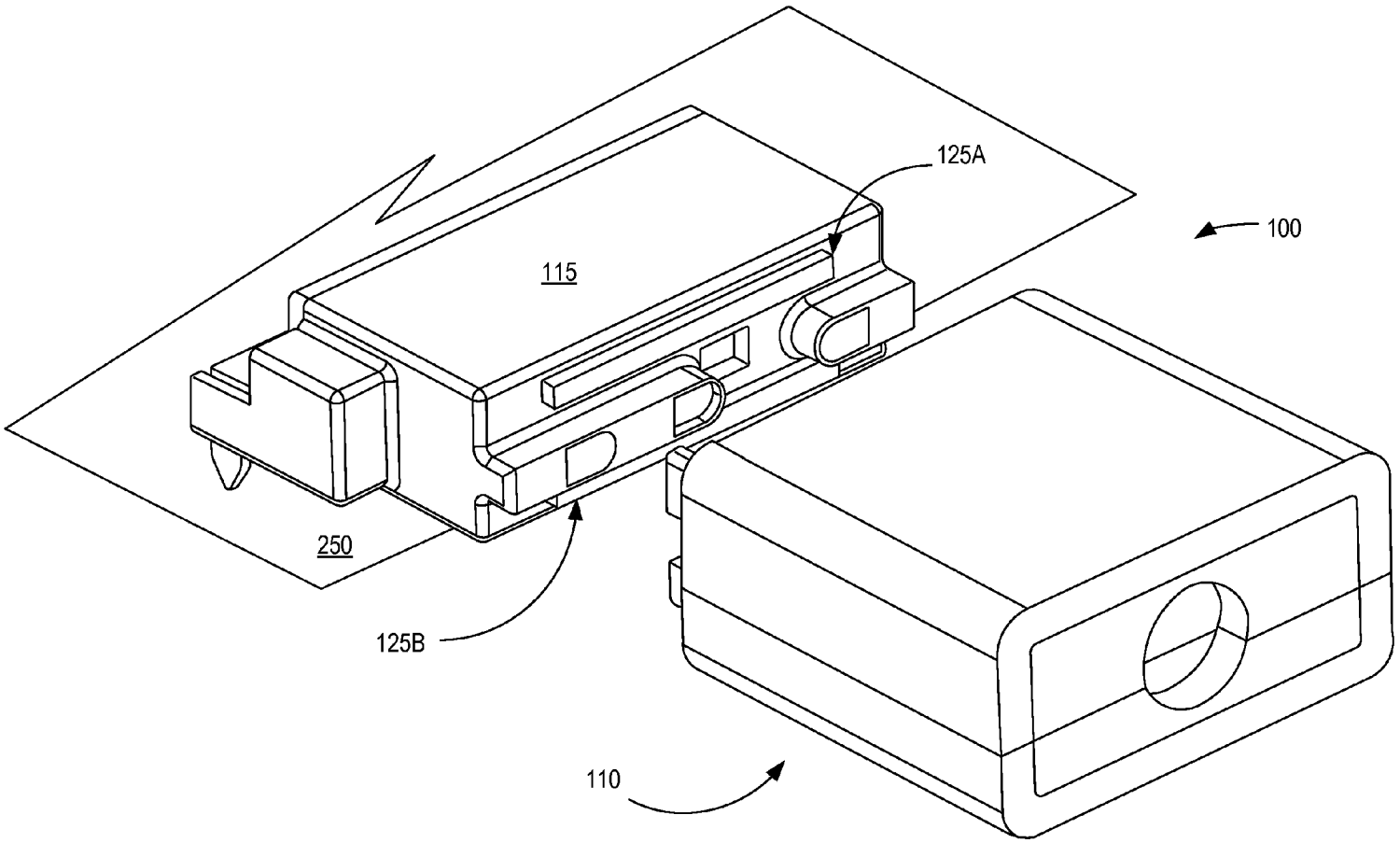
FIG. 8 illustrates an embodiment of a cable connector and an embodiment of a right-angle board connector.

FIG. 1 illustrates a connector system 100 which includes a cable-end connector 110 and a board connector 115 suitable and intended for wave- or reflow-soldering onto a printed circuit board (PC board or PCB) (#250 in FIG. 8). The connector 110 has a body 111, and the connector 115 has a body 116. A cable 105 is shown inserted into the cable-end connector 110. The bodies 111 and 116 are made of an insulating material which can withstand the applied voltages and can withstand the soldering temperatures involved, such as for soldering the cable 105 to the connector 110, and for wave- or reflow-soldering the connector 115 to a PCB. A high temperature thermoplastic is an example of such an insulating material.

Figure 2:
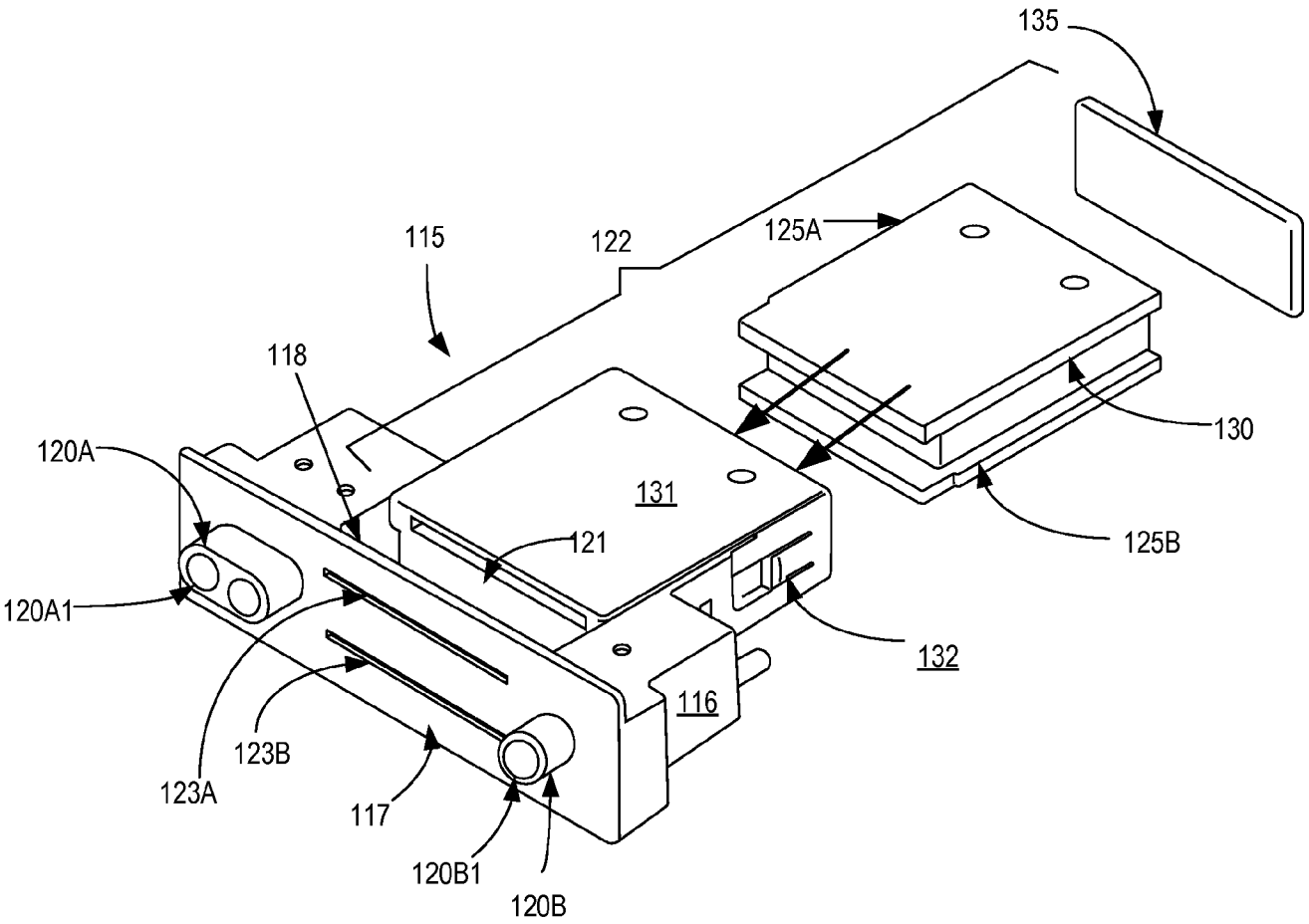
FIG. 2 illustrates an embodiment of a board connector and a magnet assembly.

The board connector 115 has a body 116, which has plugs or bosses 120A, 120B, electrical connectors 120A1, 120A2, 120B1, magnetic flux plates 125A, 125B, and a magnet (#130 of FIG. 2). The magnet and magnetic flux plates may be enclosed in a case or container 131. The magnetic flux plates 125A, 125B extend into, or through, openings 123A, 123B (FIG. 2). In an embodiment, the openings are slots.

In an embodiment, the plugs 120A, 120B preferably, but not necessarily, have a height of approximately 2 mm, a length of approximately 2 to 4 mm, and a depth of approximately 1.55 mm. The length of a plug 120 (120A, 120B) is determined primarily by the number and size of electrical contacts in the plug, the distance between electrical contacts being appropriate to prevent arcing between the contacts in view of the expected voltages on the contacts. The sockets (220A, 220B of FIG. 5) are sized to accommodate the respective plugs 120A, 120B. The different dimensions of the plugs 120A, 120B, in the board connector 115, in conjunction with the different dimensions of the sockets 220A, 220B (FIG. 5) in the cable connector 110, serve to properly align (orient, polarize) the cable and board connectors with respect to each other and to align the electrical contacts in the connectors. Also shown are exemplary electrical contacts (conductors) 120A1, 120A2, 120B1 of the connector 115.

It is preferred, for economy of material and space, that the plugs 120A, 120B and sockets 220A, 220B have electrical contacts therein and also serve to effect proper orientation of the connectors. In an alternative embodiment, some plugs and sockets may be used only for orientation and may not have electrical contacts therein, and other plugs and sockets have the electrical contacts but are not configured to provide for orientation.

By way of example, and not of limitation, the connector 115 may have a depth of 11.3 mm including the magnet assembly 122 (FIG. 2), a height of 6 mm, and a width of 20.7 mm. The connector 110 may have a depth of 10 mm, a height of 6 mm, and a width of 20.7 mm.

FIG. 2 illustrates an embodiment of a board connector 115 and a magnet assembly 122. The board connector 115 has a receiving area 121 configured and dimensioned to accept the magnet assembly 122. The magnet assembly 122 includes the magnetic flux plates 125A, 125B, and a magnet 130. The magnetic flux plates 125A, 125B are firmly held by magnetic attraction to the magnet 130. If desired, they may also be held by other means, for example, screws, glue, etc. Also shown is an optional rear cover 135, which may be made of any convenient material such as, for example, plastic. In an embodiment, the magnet assembly 122 may include the magnet 130 and the magnetic flux plates 125A, 125B, formed as a single magnetic component, and with or without the optional rear cover 135 or the optional case or container 131.

The board connector 115 may be soldered to the PC board 250 by any convenient or desired technique, such as, but not limited to, wave soldering or reflow soldering. After the connector 115 has been soldered to the board, the assembly 122 is then inserted into the receiving area 121 on the back side 118 of the connector 115. The assembly 122 is then held in the connector 115 by, for example, snap-in clips 132. The magnet assembly 122 may also be secured in the connector 115 by other techniques which allow the magnet assembly 122 to be inserted into the connector 115, but which prevent its easy removal from the connector 115, such as, but not limited to, tabs. The magnet assembly 122 may therefore be installed in the connector 115 after any soldering operations, so the heat of the soldering operation does not affect the magnet 130, and hand-soldering of the connector 115 is avoided. In an alternative embodiment, the magnet 130 and flux plates 125A, 125B may also be contained in a separate housing, case, or container, 131 that snaps into connector 115 or receiving area 121 after soldering. Also, as this housing 131 is not subjected to soldering temperatures, it may be made of a less heat-resistant material than the body 116 of the connector 115. In another alternative embodiment, as the flux plates 125A, 125B are not magnetized and are not adversely by wave- or reflow-soldering temperatures, they may be installed in the body 116 prior to the connector 115 being soldered to the PCB 250, and then the magnet 130 may be inserted or installed between the flux plates 125A, 125B after the wave- or reflow-soldering operation is completed.

Figure 3B:
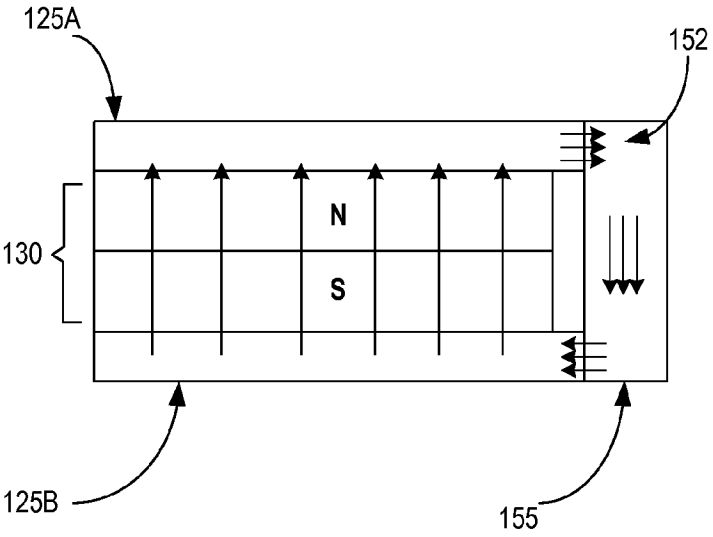
FIG. 3B illustrates a closed magnetic circuit with the magnet located between the two magnetic flux plates.
Figure 3A:
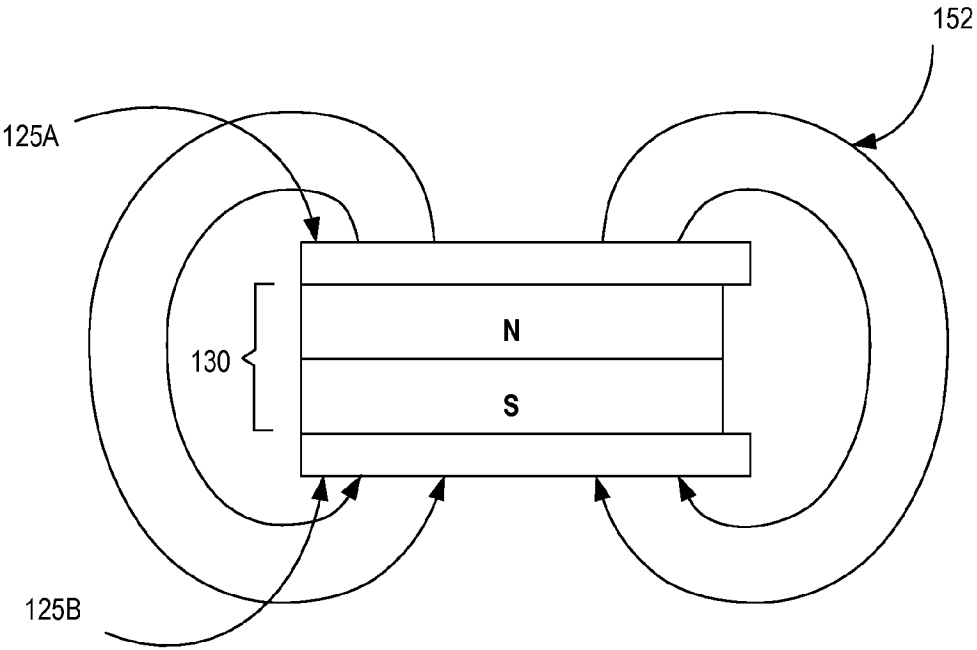
FIG. 3A illustrates an open magnetic circuit with a magnet located between two ferromagnetic plates.

FIG. 3A illustrates an open magnetic circuit with a magnet 130 located between two ferromagnetic plates, 125A and 125B. Note that the magnetic flux lines 152 between the North and South poles of the magnet traverse a low permeability path—air.

FIG. 3B illustrates a closed magnetic circuit with the magnet 130 located between the two magnetic flux plates 125A and 125B, but with a ferromagnetic strike plate 155 at one end, so that the majority of the magnetic flux lines 152 traverse the ferromagnetic strike plate 155 to form a closed magnetic circuit. The closed magnetic circuit provides a stronger magnetic attraction between components 125A, 125B and 130 on the one hand, and the strike plate component 155 on the other hand, than is provided by the magnetic attraction of the open magnetic circuit. The embodiments disclosed herein preferably use a closed magnetic circuit between the board connector 115 and the cable connector 110. The stronger attraction between the connectors 110, 115 lessens the likelihood that the connectors will be accidentally separated.

Figure 4:
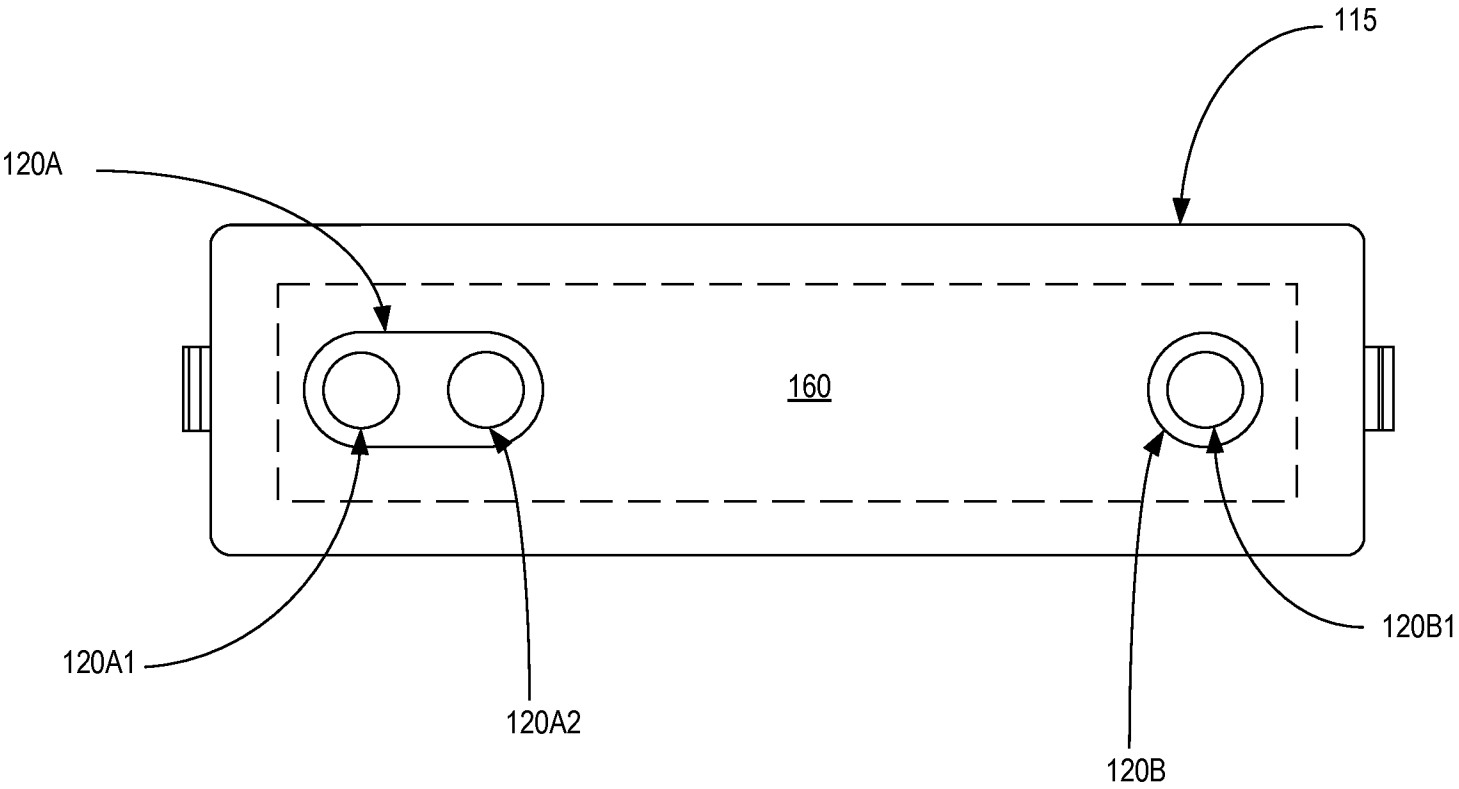
FIG. 4 illustrates an embodiment of a board connector.

FIG. 4 illustrates an embodiment of a board connector 115. In an embodiment, preferably, but not necessarily, the board connector 115 has a recessed area 160 sized to receive the cable connector 110. Also, preferably, but not necessarily, the recessed area 160 has length and height dimensions of 19.2 mm by 4.5 mm. These dimensions are not critical and other dimensions may be used as desired. For example, if more electrical contacts are desired, then it may be appropriate to make the connectors wider and/or taller to accommodate more electrical contacts.

Figure 5:
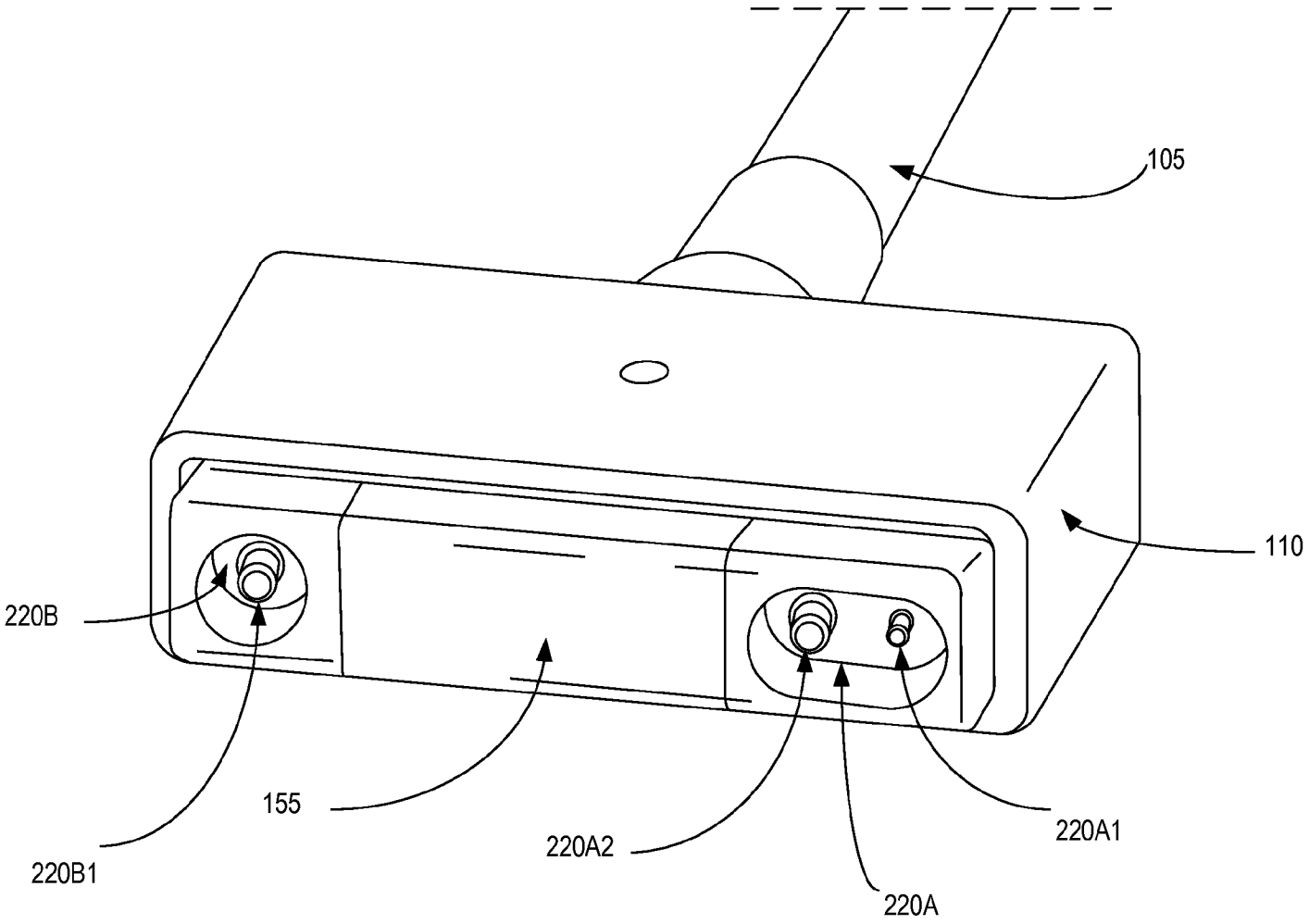
FIG. 5 is a view of one possible embodiment of a cable connector showing, for example, sockets, which are dimensioned to accommodate the plugs of the board connector.

FIG. 5 is a view of one possible embodiment of a cable connector 110 showing, for example, sockets 220A, 220B, which are dimensioned to accommodate the plugs 120A, 120B of the board connector 115. Also shown are electrical contacts 220A1, 220A2, 220B1, which make electrical contact with the electrical contacts 120A1, 120A2, 120B1 of the board connector 115 when the connectors 110, 115 are mated. Also shown is the ferromagnetic strike plate 155 which is positioned in a recessed area between the sockets 220A, 220B. The strike plate 155 may be secured in the recessed area 160 of the body 111 by an convenient method, such as but not limited to screws, glue, molding in place, etc. Preferably, but not necessarily, the front face of the sockets 220A, 220B and the front face of the strike plate 155 are in approximately the same surface plane. The plugs and sockets 120A, 120B, 220A, 220B properly orient the connectors. The magnetic retention force for the embodiment shown is in the range of 3 to 5 pounds. The magnetic retention force may be adjusted by varying the thickness of the strike plate 155. For example, a thickness of 0.75 mm results in a retention force of 3.25, a thickness of 0.90 mm results in 3.8 pounds, and a thickness of 1.2 mm results in 4.4 pounds. Of course, the retention force will also depend upon the strength of the magnet 130. In an embodiment, magnet 130 has a strength of 3000 to 5000 gauss, such as may be readily provided by a type N52 magnet.

Preferably, the strike plate 155 not magnetized. This avoids the additional cost of using another magnetized component, and also avoids implementing techniques to verify that the plate 155 will be installed, and has been installed, with the correct magnetic orientation. In another embodiment, however, the plate 155 may be magnetized, if desired, so as to provide a stronger attraction between the connectors 110 and 115, and may also serve to assist in properly orienting the connectors.

Figure 6:
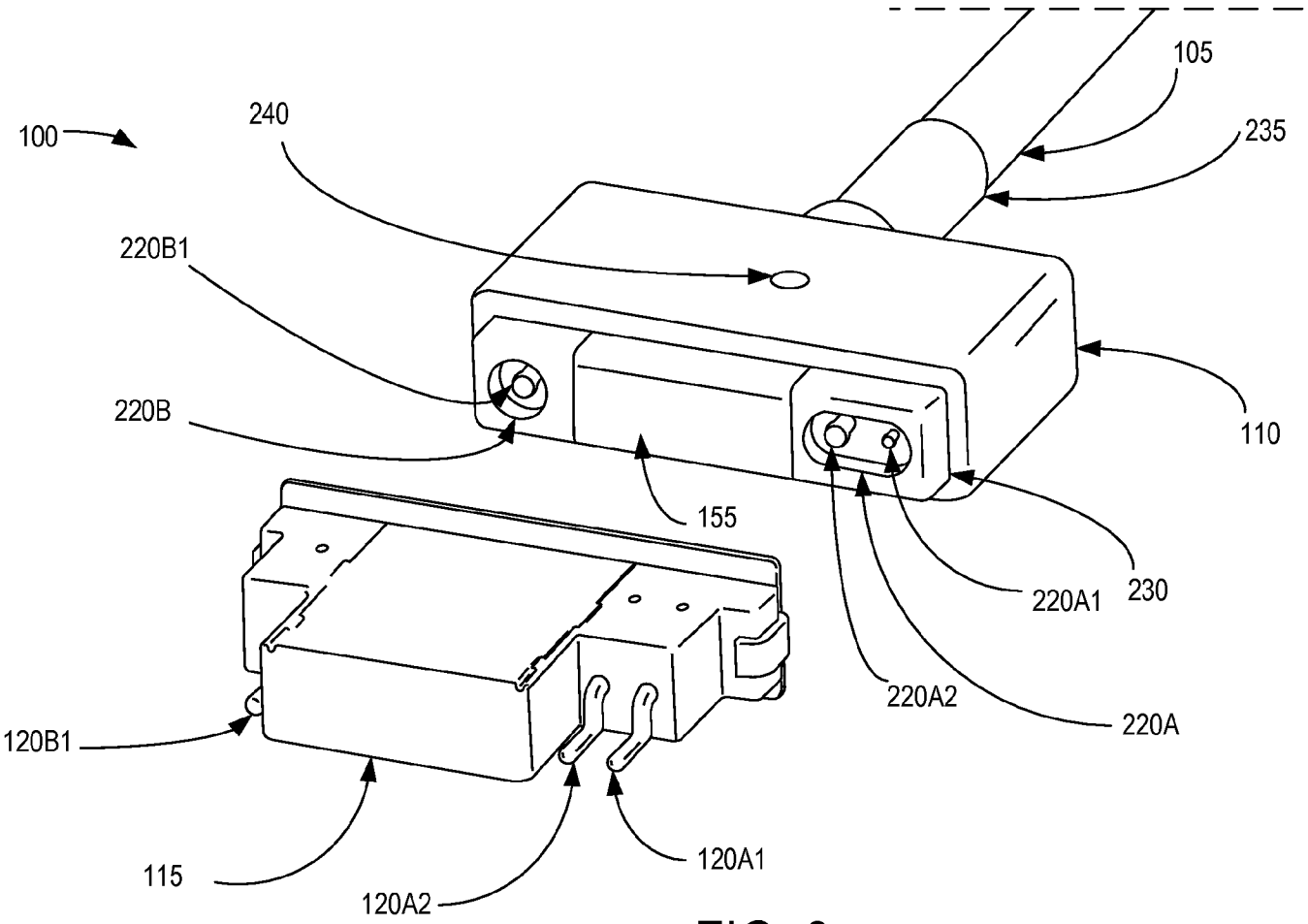
FIG. 6 is another view of the possible embodiment of a connector system.

FIG. 6 is another view of the possible embodiment of a connector system. The front insulator 230 of the cable connector 110 preferably has dimensions which fit within the recessed area 160 (FIG. 4) of the board connector 115. Preferably, but not necessarily, the insulator 230 has a length of 18.7 mm, a height of 4.0 mm, and a depth of 2 mm. FIG. 6 also illustrates a rear view of one possible embodiment of an in-line board connector 115, and shows one possible embodiment of the electrical contacts 120A1, 120A2, 120B1.

Preferably, but not necessarily, a strain relief 235 is used with respect to the cable 105 and cable connector 110. In one embodiment, the cable 105 has an outer diameter of 3.5 mm. Other diameters may be used, as desired, or to accommodate a particular installation or use.

Also, if desired, an LED status indicator 240 may be used on, for example, the cable connector 110. The indicator 240 may be connected to one or more of the contacts 220A1, 220A2, 220B1 to signify different events. For example, a green LED may be connected between power and ground contacts to indicate that power is on, and a yellow LED may be connected between a signal contact and a ground (or power) contact to indicate that a battery is charging.

Figure 7:
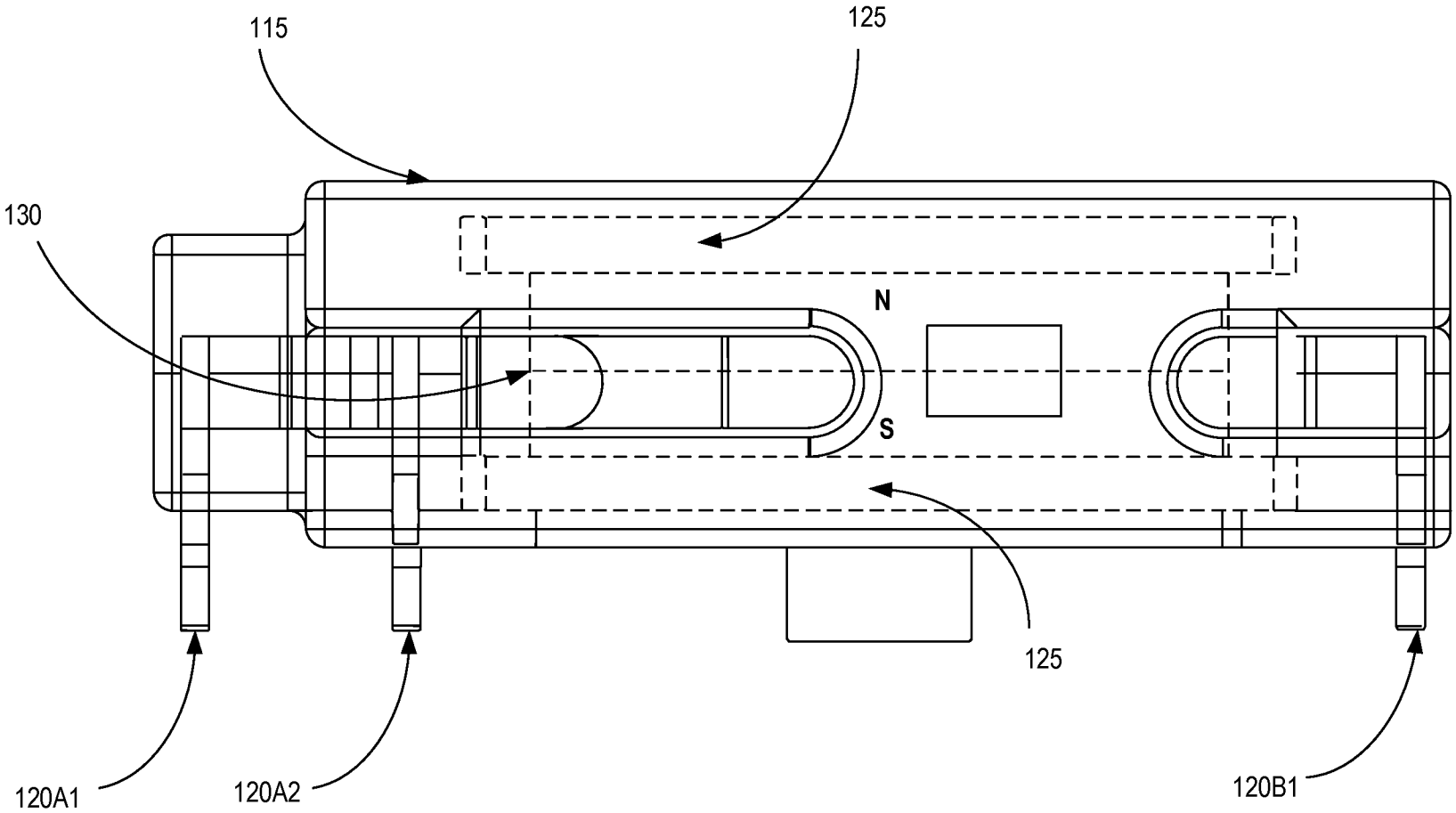
FIG. 7 illustrates an embodiment of a right-angle board connector showing the magnetic flux plates, and the magnet.

FIG. 7 illustrates a rear view of an embodiment of a right-angle board connector 115 showing, for example, the magnetic flux plates 125A, 125B (collectively, magnetic flux plates 125), and the magnet 130. The two magnetic flux plates 125A, 125B, and the ferromagnetic element 155 in the cable connector 110, magnetically couple the connectors 110 and 115 together, and maintain the electrical pins and contacts in an electrically conductive relationship.

FIG. 8 illustrates an embodiment of a cable connector 110 and an embodiment of a right-angle board connector 115. The magnetic flux plates 125A and 125B are shown. Other components are also shown but are not numbered.

Figure 9:
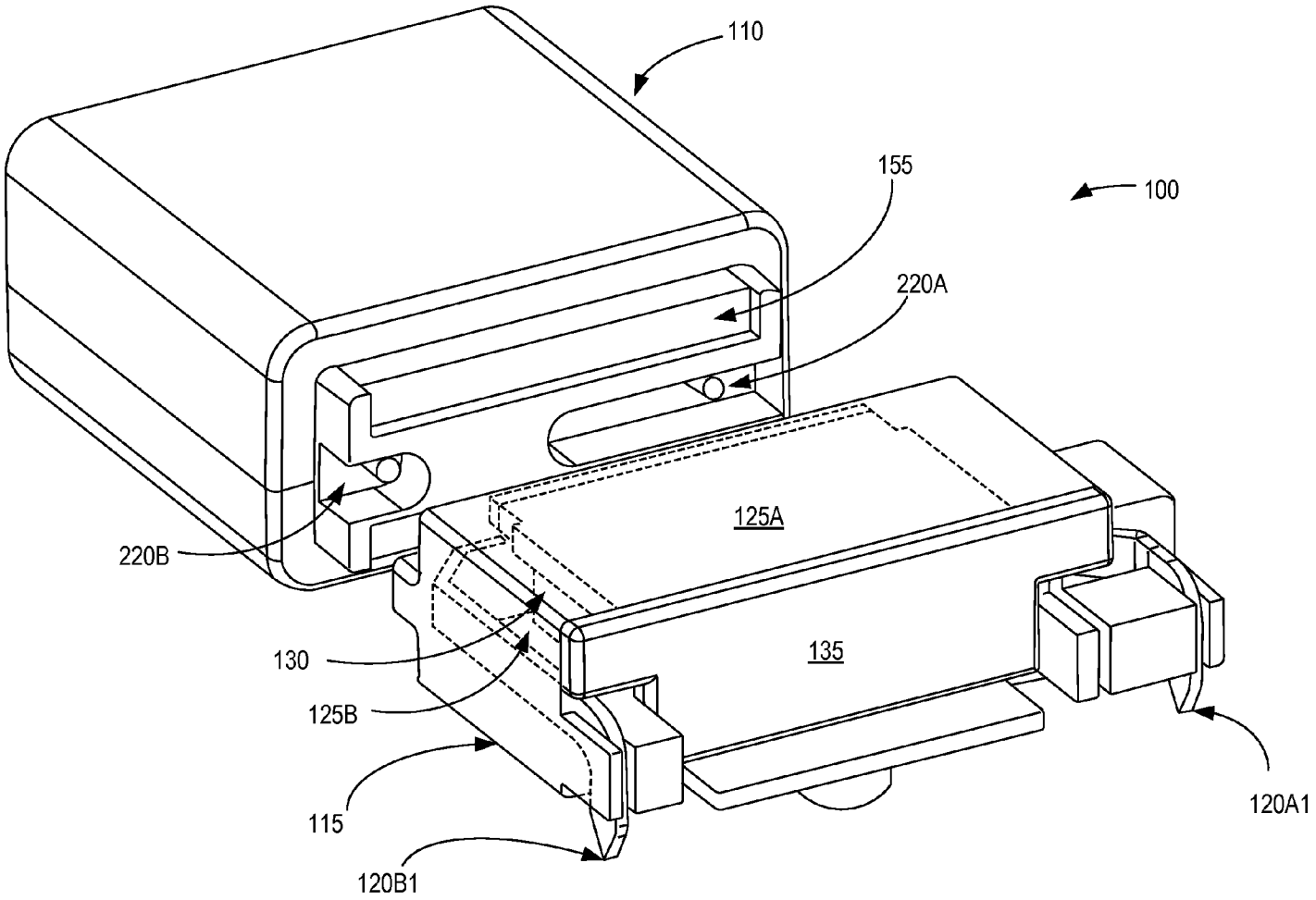
FIG. 9 also illustrates an embodiment of a cable connector and an embodiment of a right-angle board connector.

FIG. 9 also illustrates an embodiment of a cable connector 110 and an embodiment of a right-angle board connector 115. The strike plate 155, the magnetic flux plates 125A, 125B, the magnet 130, the optional cover plate 135, and the sockets 220A, 220B are shown. Other components are also shown but are not numbered.

The shape of the sockets 220A, 220B of the cable-end connector 110 may be closed, as shown in FIGS. 5 and 6, or may be open-ended, as shown in FIG. 9. Also, if desired, the shape of one of the sockets 220A, 220B may be closed, and the shape of the other socket may be open-ended. The plugs 120A, 120B and their respective sockets 220A, 220B have matching shapes.

The electrical contacts 120A1, 120A2, 120B1, 220A1, 220A2, 220B1 may be implemented as 2, 3, 4, 5, etc., pins (contacts), as desired for a particular installation or use. The pins are typically for ground and power, and may also provide one or more signal paths. The electrical contacts are preferably rated for 3 amps or 5 amps, but may have another rating appropriate for a particular installation or use. The electrical contacts 120A1, 120A2, 120B1 of the board connector 110 may be in-line, as shown in FIGS. 2 and 6, or may be at right angles, as shown in FIGS. 7-9.

The separate magnet assembly 122 allows the magnet 130 to be installed after any high-temperature soldering operations, thus eliminating the need for hand-soldering. Also, the closed magnetic circuit provides for a stronger attractive force to hold the connectors together.

It should be noted that the magnet assembly 122 may be also be configured in an open-circuit magnet configuration, if desired for some reason. This still allows the magnet assembly 122 to be installed after the board connector 115 has wave- or reflow-soldered to the PC board.

Thus, a method of using the magnetic connectors described herein would be to install the connector 115 on a PC board, wave- or reflow-solder the connector 115 to the PC board, and then insert the magnet assembly 122 into the connector 115.

Based on the foregoing, it should be appreciated that a heat resistant magnetic connector system has been disclosed herein. Although the subject matter presented herein has been described in language specific to systems, methodological acts, mechanical and physical operations and/or configurations, and manufacturing processes, it is to be understood that the invention disclosed herein is not necessarily limited to the specific features, configurations, or components described herein. Rather, the specific features, configurations and components are disclosed as example forms. Further, all of the various features, configurations, and components need not be embodied in a single item to gain the benefits of other features, configurations, and components. For example, a magnetic connector is provided that may be installed on a printed circuit board by wave-soldering or reflow-soldering, and without hand-soldering.

The subject matter described herein is provided by way of illustration for the purposes of teaching, suggesting, and describing, and not limiting. Alternatives to the illustrated embodiment are contemplated, described herein, and set forth in the claims. Various modifications and changes may be made to the subject matter described herein without following the example embodiments and applications illustrated and described, and without departing from the true spirit and scope of the present invention.

It should be appreciated that the above-described subject matter may also be implemented as an electrical apparatus, a manufacturing process, an electrical and mechanical system, or as an article of manufacture. The features, functions, and advantages that have been discussed can be achieved independently in various embodiments of the present disclosure or may be combined in yet other embodiments.

What is claimed is:

1. A heat resistant magnetic electrical connector comprising:

a body formed from an electrically insulating material which is tolerant of temperatures associated with wave- or reflow-soldering the heat resistant magnetic electrical connector to a printed circuit board, the body comprising:

first and second plugs extending from a face of the body, the first plug being located toward a first end of the face and having a first width, the second plug being located toward a second, opposite end of the face and having a second, different width;

a receiving area on a back side of the body;

retainers; and first and second openings positioned between the first and second plugs and extending from the face through the body to the receiving area;

first and second electrical conductors extending through the body, the electrical conductors forming exposed first and second electrical contacts, respectively, forward of the face, and forming first and second connector pins, respectively, at respective first and second predetermined locations other than the face or forward of the face, and wherein the first and second connector pins are configured for being wave- or reflow-soldered to conductors on the printed circuit board; and a magnet assembly having a first end and a second end, the first end having first and second extensions, the magnet assembly being inserted into the receiving area after the first and second electrical conductors have been wave- or reflow-soldered to the printed circuit board, wherein the first and second extensions extend into the first and second openings, and wherein the retainers hold the magnet assembly at least partially within the receiving area once the magnet assembly is inserted therein.

2. The heat resistant magnetic electrical connector of claim 1 wherein:

the magnet assembly comprises first and second magnetic flux plates and a magnet, the first and second magnetic flux plates being parallel to each other;

the first magnetic flux plate has a first end forming the first extension extending into the first opening;

the second magnetic flux plate has a first end forming the second extension extending into the second opening; and the second end of the magnet assembly comprises a second end of the first magnetic flux plate, a second end of the second magnetic flux plate, and the magnet.

3. The heat resistant magnetic electrical connector of claim 1 wherein:

the first plug has a surface distal from the face and the second plug has a surface distal from the face;

the first electrical conductor extends through the first plug so that the exposed first electrical contact is on the surface of the first plug; and the second electrical conductor extends through the second plug so that the exposed second electrical contact is on the surface of the second plug.

4. The heat resistant magnetic electrical connector of claim 1 and further comprising:

a third electrical conductor extending through the body, the third electrical conductor forming an exposed third electrical contact at the face and forming a third connector pin at a third predetermined location not on the face, and the third connector pin being configured for installation onto the printed circuit board; and wherein:

the first plug has a surface distal from the face and the second plug has a surface distal from the face;

the first electrical conductor extends through the first plug so that the exposed first electrical contact is on the surface of the first plug;

the second and third electrical conductors extend through the second plug so that the respective exposed second and third electrical contacts are on the surface of the second plug; and the second width is greater than the first width.

5. The heat resistant magnetic electrical connector of claim 1 wherein:

the magnet assembly comprises first and second magnetic flux plates, a magnet, and a case;

the first magnetic flux plate has a first end forming the first extension extending into the first opening;

the second magnetic flux plate has a first end forming the second extension extending into the second opening;

the second end of the magnet assembly comprises a second end of the first magnetic flux plate, a second end of the second magnetic flux plate, and the magnet; and the case encompasses the first and second magnetic flux plates and the magnet except for the first extension and the second extension.

6. A method for manufacturing a heat resistant magnetic electrical connector, the method comprising:

providing a body formed from an electrically insulating material which is tolerant of temperatures associated with wave- or reflow-soldering the heat resistant magnetic electrical connector to a printed circuit board, the body comprising:

first and second plugs extending from a face of the body, the first plug being located toward a first end of the face and having a first width, the second plug being located toward a second, opposite end of the face and having a second, different width;

a receiving area on a back side of the body;

retainers; and first and second openings positioned between the first and second plugs and extending from the face through the body to the receiving area;

inserting first and second electrical conductors into the body, the first and second electrical conductors extending through the body, the electrical conductors forming exposed first and second electrical contacts, respectively, forward of the face and forming first and second connector pins, respectively, at respective first and second predetermined locations not on the face or forward of the face, and wherein the first and second connector pins are configured for being wave- or reflow-soldered to conductors on the printed circuit board; and providing a magnet assembly having a first end and a second end, the first end having first and second extensions, the magnet assembly being for insertion into the receiving area after the first and second electrical conductors have been wave- or reflow-soldered to the printed circuit board, wherein the first and second extensions extend into the first and second openings, and wherein the retainers hold the magnet assembly at least partially within the receiving area once the magnet assembly is inserted therein.

7. The method of claim 6 wherein separately providing a magnet assembly comprises:

providing a first magnetic flux plate having a first end forming a first extension;

providing a second magnetic flux plate having a first end forming a second extension, the first and second magnetic plates being parallel to each other; and inserting a magnet, between the first magnetic flux plate and the second magnetic flux plate, and away from the first extension and the second extension.

8. The method of claim 6 and further comprising providing the body such that:

the first plug has a surface distal from the face and the second plug has a surface distal from the face;

the first electrical conductor extends through the first plug so that the exposed first electrical contact is on the surface of the first plug; and the second electrical conductor extends through the second plug so that the exposed second electrical contact is on the surface of the second plug.

9. The method of claim 6 and further comprising:

providing the body such that:

the second width is greater than the first width; and the first plug has a surface distal from the face and the second plug has a surface distal from the face; and inserting a third electrical conductor into the body, the third electrical conductor extending through the body, the third electrical conductor forming an exposed third electrical contact and forming a third connector pin at a third predetermined location not on the face or forward of the face, the third connector pin being configured for being wave- or reflow-soldered to a conductor on the printed circuit board; and wherein the first electrical conductor extends through the first plug so that the exposed first electrical contact is on the surface of the first plug and the second and third electrical conductors extend through the second plug so that the respective exposed second and third electrical contacts are on the surface of the second plug.

* * * * *